US006684674B2

(12) United States Patent
Focken

(10) Patent No.: US 6,684,674 B2
(45) Date of Patent: Feb. 3, 2004

(54) TREAD ROLLING HEAD

(75) Inventor: Andreas Focken, Schwarzenbek (DE)

(73) Assignee: Wilhelm Fette GmbH, Schwarzenbek (DE)

( * ) Notice: Subject to any disclaimer, the term of this patent is extended or adjusted under 35 U.S.C. 154(b) by 0 days.

(21) Appl. No.: 10/066,191

(22) Filed: Jan. 31, 2002

(65) Prior Publication Data

US 2002/0108418 A1 Aug. 15, 2002

(30) Foreign Application Priority Data

Feb. 13, 2001 (DE) ..... 201 02 471

(51) Int. Cl.[7] ..... B21D 3/02
(52) U.S. Cl. ..... 72/121; 72/104; 72/108
(58) Field of Search ..... 72/104, 108, 120, 72/121

(56) References Cited

U.S. PATENT DOCUMENTS 3,972,213 A * 8/1976 Habegger ..... 72/104
5,724,844 A * 3/1998 Saeki ..... 72/75
5,784,912 A * 7/1998 Focken et al. ..... 72/104
5,868,019 A * 2/1999 Grabbe ..... 72/4
5,870,918 A * 2/1999 Schunk et al. ..... 72/104

FOREIGN PATENT DOCUMENTS

DE 4236085 C2 4/1994
DE 4430184 C2 3/1995
DE 19701049 C1 1/1997

OTHER PUBLICATIONS

"Fette Rollsysteme" Company Publication pp. 77 and 199 (German with English translation attached).

* cited by examiner

*Primary Examiner*—Ed Tolan
(74) *Attorney, Agent, or Firm*—Faegre & Benson LLP

(57) ABSTRACT

An axial thread rolling head comprising a bearing unit including rolling dies supported via eccentric shafts, a shank which is axially movable with respect to the bearing unit and has a clutch portion which interacts with a claw clutch portion of a spring housing rotatably supported on the shank in a first axial relative postion and which couples the two components in a torsion-resistant manner, and a first gearing between the shank and the eccentric shafts for varying the mutual spacing of the rolling dies, a spiral-coiled spring between the shank and the bearing unit and mechanical switching means to move the shank and the bearing unit into the second relative position when in contact with a workpiece, wherein at least the bearing unit and the spring housing are formed from titanium or a titanium alloy.

10 Claims, 2 Drawing Sheets

TREAD ROLLING HEAD

This application claims priority under 35 U.S.C. 119 of German Patent Application No. 201 02 471.3, filed Feb. 13, 2001.

The invention relates to a thread rolling head, more specifically an axial or radial thread rolling head.

Thread rolling heads are generally known. An axial thread rolling head, for example, is disclosed in DE 44 30 184. Just as other conventional axial thread rolling heads do it has three profiled rolling dies offset by 120° from each other which are rotatably supported in a bearing unit. The bearing unit is held by a shank which is gripped in a machine tool. The rolling head is held in place in the sense of rotation, but can move axially. The rolling head is pressed onto the rotating tool with the forward feed being performed by the rolling head, which is freely movable axially, while the thread is being formed. The profiled rolling dies are mounted on eccentric shafts which when actuated bring the rollers into engagement with the tool. The eccentric shafts are operated via pinions which mesh with a central toothed gear or a circular toothed gear with the circular toothed gear when operated cause the profiled rolling dies to be shifted relative to the workpiece. The eccentric shafts are preferably biased by a spiral-coiled spring and will be biased into the initial position at the end of machining. The spiral-coiled spring is supported in a spring housing which constitutes a clutch portion for a claw clutch with these parts having disposed therebetween an actuation ring which interacts with a ring-shaped ball cage retainer. A front-end plate at the front end of the axial thread rolling head serves for supporting the eccentric shafts.

A radial rolling head as is known, for example, from DE 42 36 085 or DE 197 01 049 features profiled rollers or rolling dies which exhibit a course of their surface that helically ascends in opposition to their sense of rotation over the circumference. The rolling dies are coupled to a gearing mechanism and an inter-locking mechanism is automatically disengaged after every complete turn of the rolling dies. The interlocked state is released prior to the rolling operation, i.e. by the workpiece which is to be deformed by the rolling dies. Flattened areas of the rolling dies oppose each other in the initial position to thereby permit the insertion of the workpiece. The rolling dies are rotated via pinions which mesh with a central toothed gear which is driven by an appropriate drive. This purpose is served by a spring mechanism which turns the rolling dies until they get into contact with the workpiece. The rolling operation will start subsequently, and the frictional grip existing between the rotated workpiece and the rolling dies causes the rolling dies to be kept rotating and the spring mechanism to be tensioned again. The rolling operation always lasts only for a single rotation of the rolling dies. The spring mechanism includes a spring housing which is gripped in the machine tool via a shank. Pinions of the drive interact with a toothed rim with the pinions acting on pinions coupled to the shafts of the profiled rollers. The latter ones are supported in a gearing plate.

What ensues from the above explanations is that the axial rolling head is either at stoppage or rotates while the workpiece, in turn, is rotating or is at stoppage. This allows to produce nearly all thread shapes with the profile length not being limited. The radial rolling head permits extremely short lengths of thread runout and makes possible extremely short threads. Moreover, the machining time is very short. Even here, the workpiece is either at stoppage or rotates while the rolling head either is rotating or is at stoppage.

For more details, reference is made to the above mentioned state of the art and the company publication "Fette Rollsysteme". The rolling systems described are frequently employed in so-called automatic rolling machines which operate at short switching times and high accelerations. It is understood that the rolling heads which are relatively heavy set limits to the switching and machining times.

Therefore, it is the object of the invention to provide an axial and/or radial rolling head that admits shorter switching times and higher accelerations.

The axial thread rolling head of the present invention has formed therein at least the bearing unit and/or the spring housing in titanium or a titanium alloy. According to an aspect of the invention, an actuation ring between the clutch portion and the spring housing and/or a front-end plate for supporting the eccentric shafts are also formed in titanium or a titanium alloy. According to another aspect of the invention, a toothed rim for the pinions seated on the eccentric shafts is also formed in titanium or a titanium alloy.

The radial thread rolling head according to the invention has formed therein the shank and/or the spring housing and/or the gearing plate in titanium or a titanium alloy. According to an aspect of the invention, a front-end plate supporting the rolling dies is also formed in titanium or a titanium alloy.

The inventive thread rolling heads have formed therein those components which have a relatively large mass, but are not subjected to particular stresses, in the relatively light-weight titanium or a titanium alloy. This way makes it possible to significantly reduce the weight of the thread rolling heads, namely by from 25 to 30%.

The present invention includes an axial thread rolling head comprising a bearing unit including the rolling dies in which the rolling dies are rotatably supported via eccentric shafts, a shank which is axially movable with respect to the bearing unit and has a clutch portion which, in a first axial relative position, interacts with a claw clutch portion of a ring-shaped spring housing of the bearing unit that is rotatably supported on the shank, which couples the two components in a torsion-resistant manner, a first gearing between the shank and the eccentric shafts for varying the mutual spacing of the rolling dies, a spiral-coiled spring between the shank and the bearing unit such that rotating the bearing unit with respect to the shank in a first sense of rotation will cause the spiral-coiled spring to tension the shank and the bearing unit towards each other into the first relative position and that, in a second axial relative position in which the claw clutch portions are out of engagement, the tensioned spiral-coiled spring will rotate the bearing unit relative to the shank into a second sense of rotation, which will open the rolling die via the first gearing, and mechanical switching means which if in a contact with a workpiece will move the shank and the bearing unit into the second relative position, which involves that at least the bearing unit and the spring housing are formed from titanium or a titanium alloy.

The invention will now be explained in more detail with reference to embodiments shown in the drawings.

Figure 1:
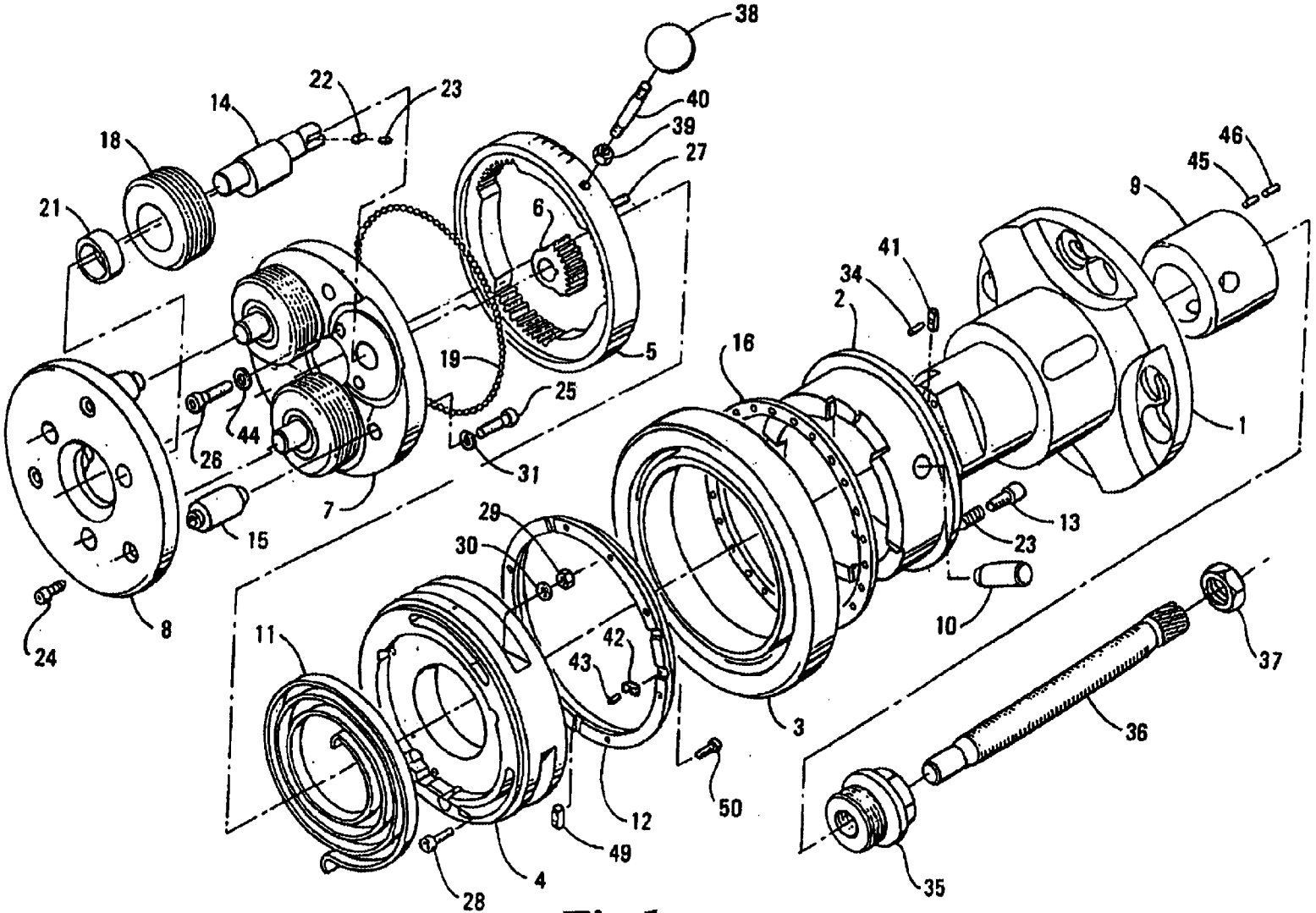
FIG. 1 shows an exploded view of an axial thread rolling head according to the invention.
Figure 2:
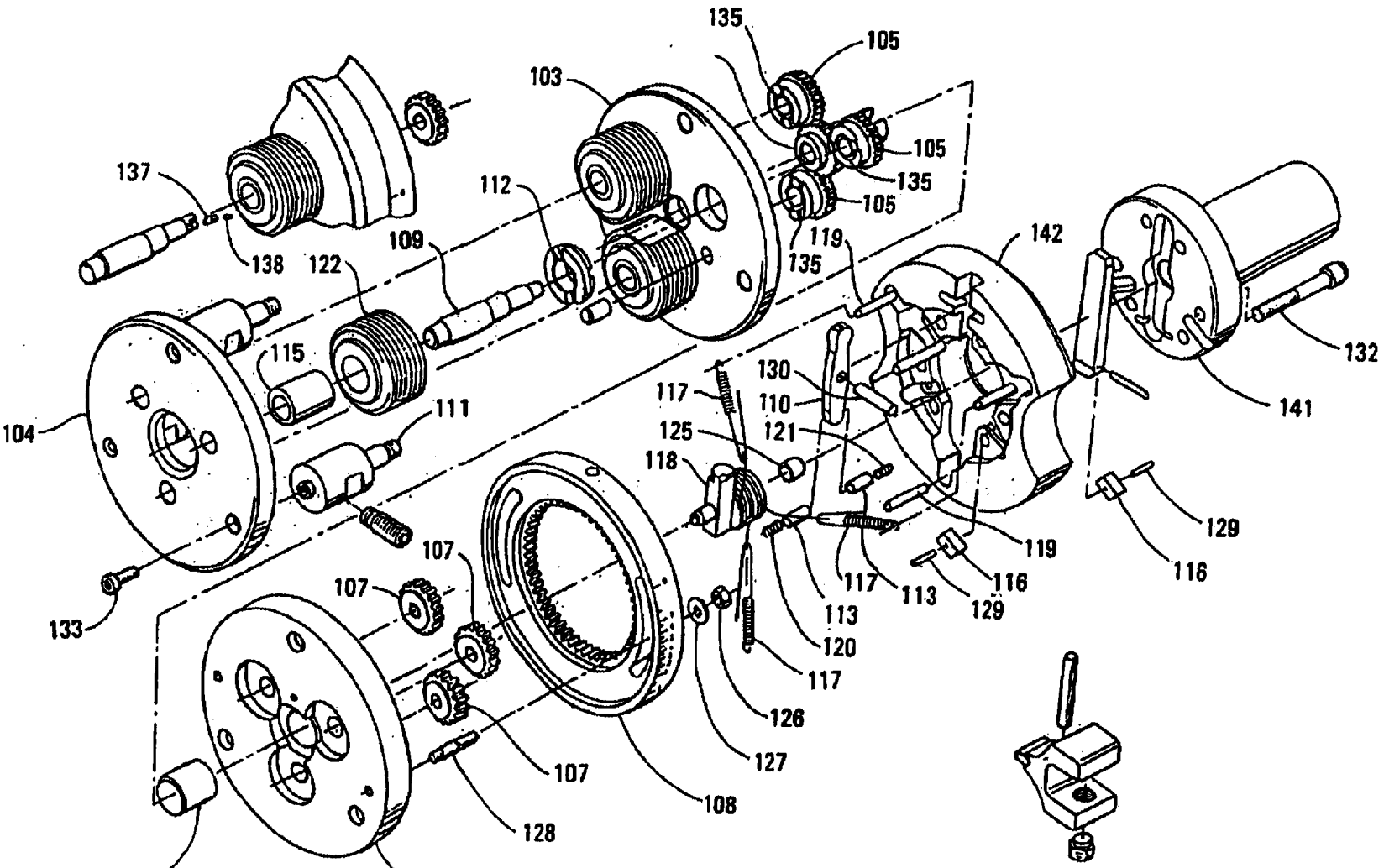
FIG. 2 shows an exploded view of a radial thread rolling head according to the invention.

In FIGS. 1 and 2, the components of the rolling heads shown are all known per se with reference being made to the company publication "Fette Rollköpfe" which was mentioned already. Nevertheless, the individual components of the rolling heads will be briefly referred to. As far as their function is concerned reference is made to the documents which were mentioned above and were also published by the applicant company. Moreover, this function is generally known to persons skilled in the art.

Referring to FIG. 1, the following components are shown: Driving dog 1, clutch 2, actuation ring 3, spring housing 4, toothed rim 5, toothed sector 6, intermediate plate 7, front-end plate 8, sleeve 9, pin 10, spiral-coiled spring 11, brake blade 12, spring pin 13, eccentric pin 14, spacer pin 15, ball cage retainer 16, rolling die 18, steel ball 19, cemented-carbide bushing 21, feather key 22, compression spring 23, flat fillister-head screw 24, flat fillister-head screw 25, flat fillister-head screw 26, stud bolt 27, flat fillister-head screw 28, hexagon nut 29, washer 30, spring washer 31, cylindrical pin 33, retaining bush 34, screw-in socket 35, contact screw 36, hexagon nut 37, ball-type head 38, hexagon nut 39, handle 40, feather key 41, feather key 42, retaining bush 43, locking ring 44, threaded pin 45, threaded pin 46, clutch element 49, threaded bolt 50.

Out of the components shown in FIG. 1, the actuation ring 3, the spring housing 4, the toothed rim 5, the intermediate plate 7, and the front-end plate 8 are made of titanium or a titanium alloy. The front-end plate 8 will expediently be manufactured from a titanium alloy only if it is of an appropriate thickness.

The radial thread rolling head of FIG. 2 includes the following components: Gearing plate 102, cover plate 103, front-end plate 104, synchronizing gear 105, intermediate gear 106, displacing gear 107, toothed rim 108, eccentric pin 109, outer release lever 110, spacer pin 111, dog plate 112, clutch pin 113, bushing 115, feather key 116, extension spring 117, stop 118, cylindrical pin 119, compression spring 120, compression spring 121, rolling die 122, DU bushing 125, hexagon nut 126, washer 127, stud bolt 128, locking pin 129, cylindrical pin 130, flat fillister-head screw 132, flat fillister-head screw 133, DU bushing 134, DU bushing 135, feather key 137, cylindrical pin 138, spring housing 142, shank 145.

Out of the components shown, the gearing plate 102, the front-end plate 104, the toothed rim 108, the spring housing 142, and the shank 141 are formed from titanium or a titanium alloy. The front-end plate 104 will be manufactured from the more light-weight workpiece if it is of an appropriate thickness.

What is claimed is:

1. An axial thread rolling head comprising a bearing unit including the rolling dies in which the rolling dies are rotatably supported via eccentric shafts, a shank which is axially movable with respect to the bearing unit and has a clutch portion which, in a first axial relative position, interacts with a claw clutch portion of a ring-shaped spring housing of the bearing unit that is rotatably supported on the shank, which couples the two components in a torsion-resistant manner, a first gearing between the shank and the eccentric shafts for varying the mutual spacing of the rolling dies, a spiral-coiled spring between the shank and the bearing unit such that rotating the bearing unit with respect to the shark in a first sense of rotation will cause the spiral-coiled spring to tension die shank and the bearing unit towards each other into the first relative position and that, in a second axial relative position in which the claw clutch portions are out of engagement the tensioned spiral-coiled spring will rotate the bearing unit relative to the shank into a second sense of rotation, which will open the rolling die via the first gearing, and mechanical switching means which if in a contact with a workpiece will move the shank and die bearing unit into the second relative position, characterized in that at least the bearing unit and the spring housing are formed from titanium or a titanium alloy.

2. The axial thread rolling head according to claim 1, characterized in that an actuation ring (3) between the clutch portion (2) and the spring housing (4) and/or a front-end plate (8) for supporting the eccentric shafts (14) are also formed from titanium or a titanium alloy.

3. The axial thread rolling head according to claim 1, characterized in that a toothed rim (5) for the pinions (6) seated on the eccentric shafts (14) is also formed from titanium or a titanium alloy.

4. The axial thread rolling head according to claim 2, characterized in that a toothed rim (5) for the pinions (6) seated on the eccentric shafts (14) is also formed from titanium or a titanium alloy.

5. A radial rolling head comprising a holder which accommodates rolling dies disposed around the rolling die axis at equal angular spacings and at equal distances between axles the rolling surfaces of which exhibit a course which helically ascends in opposition to their sense of rotation over the circumference, including a gearing mechanism coupling the rolling dies to each other, which has the pinion coupled to the rolling dies and a central tooted gear meshing with the pinions, an interlocking mechanism for the rollers which automatically locks into place after every complete turn of the roiling dies and is released prior to every rolling operation, a stop which is adapted to be engaged with the workpiece while a workpiece is undergoing an introducing motion in between the rolling dies and which releases the interlocked state, and a driving device which has a spring housing receiving extension springs, a shank, a toothed rim with pinions for the reversed turn of the rolling dies, and a gearing plate for the two gearing mechanisms with the rollers, once the interlocked state is released, will rotate until the rolling die surfaces bear against the workpiece in order to be kept rotating along with it by friction, characterized in that the shank (41) and/or the spring housing (42) and/or the gearing plate (2) are formed from titanium or a titanium alloy.

6. The radial thread rolling head according to claim 5, characterized in that a front-end plate (4) supporting the rolling dies (22) is also formed from titanium or a titanium alloy.

7. The radial thread rolling head according to claim 5 wherein the shank and the spring housing are formed from titanium or a titanium alloy.

8. The radial thread rolling head according to claim 5 wherein the shank and the gearing plate are formed from titanium or a titanium alloy.

9. The radial thread rolling head according to claim 5 wherein the spring housing and the gearing plate are formed from titanium or a titanium alloy.

10. The radial thread rolling head according to claim 5 wherein the shank and the spring housing and the gearing plate are formed from titanium or a titanium alloy.

* * * * *

UNITED STATES PATENT AND TRADEMARK OFFICE

CERTIFICATE OF CORRECTION

PATENT NO. : 6,684,674 B2
DATED : February 3, 2004
INVENTOR(S) : Andreas Focken

It is certified that error appears in the above-identified patent and that said Letters Patent is hereby corrected as shown below:

Column 3,
Lines 56 and 57, should read as follows:
-- ...to the shank in a first sense of rotation will cause the spiral-coiled spring to tension the... --

Column 4,
Line 3, should read as follows:
-- …move the shank and the bearing unit… --
Line 27, should read as follows:
-- ...and a central toothed gear meshing… --
Line 30, should read as follows:
-- ...the rolling dies and is... --

Signed and Sealed this

Eighteenth Day of May, 2004

JON W. DUDAS
*Acting Director of the United States Patent and Trademark Office*